US010640967B2

(12) United States Patent
Fritschi

(10) Patent No.: US 10,640,967 B2
(45) **Date of Patent: *May 5, 2020**

(54) STRUCTURAL ELEMENT FOR THERMAL INSULATION

(71) Applicant: Schöck Bauteile GmbH, Baden-Baden (DE)

(72) Inventor: Hubert Fritschi, Baden-Baden (DE)

(73) Assignee: Schöck Bauteile GmbH, Baden-Baden (DE)

( * ) Notice: Subject to any disclaimer, the term of this patent is extended or adjusted under 35 U.S.C. 154(b) by 0 days.

This patent is subject to a terminal disclaimer.

(21) Appl. No.: 15/845,123

(22) Filed: Dec. 18, 2017

(65) Prior Publication Data

US 2018/0171619 A1 Jun. 21, 2018

(30) Foreign Application Priority Data

Dec. 19, 2016 (DE) ..... 10 2016 124 736

(51) Int. Cl.
*E04B 1/00* (2006.01)
*E04C 5/07* (2006.01)
*E04C 5/02* (2006.01)

(52) U.S. Cl.
CPC ..... *E04B 1/0038* (2013.01); *E04C 5/073* (2013.01); *E04C 5/02* (2013.01)

(58) Field of Classification Search
CPC ..... E04B 1/0038; E04C 5/073; E04C 5/02
See application file for complete search history.

(56) References Cited

U.S. PATENT DOCUMENTS 3,555,753 A * 1/1971 Magadini ..... E04B 5/023 52/223.7
4,959,940 A * 10/1990 Witschi ..... E04B 1/0038 52/223.13

(Continued)

FOREIGN PATENT DOCUMENTS

DE 4103278 8/1992
DE 4424278 1/1996

(Continued)

*Primary Examiner* — Rodney Mintz
(74) *Attorney, Agent, or Firm* — Volpe and Koenig, P.C.

(57) ABSTRACT

A structural element for thermal insulation between two building parts, particularly between a building (B) and a projecting external part (A), including an insulating body (2) to be arranged between the two building parts and including reinforcement elements in the form of at least tensile reinforcement elements (3), which in the installed state of the structural element (1) extend through it essentially horizontally and perpendicularly in reference to the essentially horizontal longitudinal extension of the insulating body, and respectively project in the horizontal direction beyond the insulating body and here can be connected to at least one (B) of the two building parts preferably made from concrete, with the tensile reinforcement elements (3) comprising an anchoring element (6, 16, 26, 36) in an area of at least one building part (B) surrounding its radial exterior, with the anchoring element at least including an anchoring bushing (6*a*, 16*a*, 26*a*, 36*a*) made from a concrete material and a profiling (6*b*, 16*b*, 26*b*, 36*b*), provided at the radial exterior of the anchoring bushing and projecting outwardly, particularly in the radial direction.

16 Claims, 4 Drawing Sheets

(56) References Cited

U.S. PATENT DOCUMENTS 5,799,457 A * 9/1998 Schumacher ..... E04B 1/0038 52/259
6,763,646 B1 * 7/2004 Bonomo ..... E04C 5/02 52/223.4
7,823,352 B2 * 11/2010 Fritschi ..... E04B 1/0038 52/405.3
8,516,761 B2 * 8/2013 Laiho ..... E01C 11/14 404/59
8,875,458 B2 * 11/2014 Fritschi ..... E04B 1/003 52/259
8,973,317 B2 * 3/2015 Larkin ..... E04B 1/7608 52/223.14
8,991,124 B2 * 3/2015 Braasch ..... C04B 26/10 52/223.8
9,382,705 B2 * 7/2016 Braasch ..... E04B 1/7604
9,598,891 B2 * 3/2017 Knoblauch ..... E04B 1/355
10,480,182 B2 * 11/2019 Fritschi ..... E04C 2/243
2006/0090416 A1 * 5/2006 Braasch ..... E04B 1/0038 52/649.1
2007/0039263 A1 * 2/2007 Fritschi ..... E04B 1/0038 52/309.16
2007/0074477 A1 * 4/2007 Fritschi ..... E04B 1/0038 52/404.2
2008/0010913 A1 * 1/2008 Fritschi ..... E04B 1/0038 52/167.1
2009/0191005 A1 * 7/2009 Schmidt ..... E02D 5/805 405/259.1
2010/0095616 A1 * 4/2010 Braasch ..... C04B 26/10 52/291
2012/0174528 A1 * 7/2012 Fritschi ..... E04B 1/003 52/745.21
2012/0240496 A1 * 9/2012 Gutzwiller ..... E04B 5/43 52/223.1
2014/0202102 A1 * 7/2014 Braasch ..... E04B 1/7604 52/407.1
2014/0331581 A1 * 11/2014 Larkin ..... E04B 1/7608 52/223.14
2016/0002920 A1 1/2016 Seshappa et al.
2016/0369495 A1 * 12/2016 Hochstuhl ..... E04B 1/78
2018/0023288 A1 * 1/2018 Fritschi ..... E04B 1/0038 52/405.3
2018/0023289 A1 * 1/2018 Fritschi ..... E04B 1/0038 52/407.4
2018/0291620 A1 * 10/2018 Hollerbuhl ..... E04B 1/41

FOREIGN PATENT DOCUMENTS

DE 19736501 2/1999
DE 102011054275 A1 * 4/2013 ..... E04B 1/0038
DE 102011122589 A1 * 7/2013 ..... E04B 1/0038
EP 0947640 10/1999
EP 1564336 A1 * 8/2005 ..... E04B 1/0038
EP 1600569 11/2005

* cited by examiner

STRUCTURAL ELEMENT FOR THERMAL INSULATION

INCORPORATION BY REFERENCE

The following documents are incorporated herein by reference as if fully set forth: DE 102016124736.7, filed Dec. 19, 2016.

BACKGROUND

The present invention relates to a structural element for thermal insulation between two building parts, particularly between a building and a projecting external part.

Various embodiments of structural elements for thermal insulation are known from prior art, which serve primarily to support building parts projecting from buildings, such as balcony bases, through a thermally insulating building joint. Here, the integrated reinforcing elements ensure the required transfer of force and/or moment, while the insulating body is responsible to distance the two building parts from each other in a thermally insulating fashion and to maintain a joint.

Here, the structural elements must be used for thermal insulation at various installation situations, with primarily the elements for tensile reinforcement battling space problems, in the installed state of the structural element extending essentially horizontally and perpendicular in reference to the essentially horizontal longitudinal extension of the insulating body, passing through it, and respectively projecting in the horizontal direction from the insulating body, and here allowing building parts, preferably made from concrete, to be connected to at least one of the two building parts. Primarily in case of different levels between the two adjacent building parts, thus particularly the balcony and the ceiling plate, the tensile reinforcement elements must be arranged such that in spite of spatial problems they provide the required anchoring in the adjacent building parts.

Various approaches for a solution are known from prior art, in which the tensile reinforcement elements are embodied with, for example a curved progression in reference to the horizontal level, as shown in DE-A 197 36 501 or EP-A 0 947 640, or a stepped progression as shown in EP-A 1 600 569. This way, the tensile reinforcement elements can be adjusted in their orientation, at least in case of suitable arrangements, to the form of the abutting building part; for example a progression of the tensile reinforcement elements curved downwards can lead to the tensile reinforcement elements extending to a progression of the corresponding building part stepped in reference to the structural element for thermal insulation. Additionally, solutions are known in which the tensile reinforcement elements show complex, curved forms, for example bent into loops, in order to ensure the tensile force via a so-called overlapping joint. This approach of a solution originates particularly when tensile reinforcement elements are used in the context with cantilevers supporting facades, with the cantilevers exhibiting a very limited length in the axial direction and thus offering insufficient space for anchoring in the cantilever if any tensile reinforcement element extended in a straight and horizontal fashion.

Finally, instead of the common rod-shaped tensile reinforcement elements, it is also known to use tensile reinforcement elements comprising a head bolt, which in addition to a rod-shaped central section, passing through the joint between the two building parts, shows two conical expansions at the two ends, which ensure a positive connection between the tensile reinforcement element and the building part. While the curved or stepped tensile reinforcement elements show no particular advantage with regards to a reduction of the anchoring and/or installation length, but at best can ensure that the tensile reinforcement elements can extend into the sections of abutting building parts with different elevation levels, when the above-mentioned head bolt is used such a reduction of the anchoring and/or installation length can be yielded without any problems. However, here the reinforcements at the building must be placed precisely next to the head bolt in order to allow compensating and/or transferring tensile forces in the joint, caused by the construction, in the area of the conical expansions of the head bolt.

The major difficulty is here given, though, in that the reinforcement at the building must already be positioned and partially encased in concrete when the precise position of the head bold it not yet known. Accordingly, this approach for a solution shows a considerable disadvantage in its practical application.

SUMMARY

Based on this prior art, the objective of the present invention is to further develop a structural element for thermal insulation that allows for installation even in abutting building parts, which exhibit a reduced length in the horizontal direction perpendicular to the longitudinal extension of the insulating body and thus offer less space for anchoring the tensile reinforcement elements, which is the case for example in abutting building parts with different elevation levels in reference to each other.

This objective is attained by a structural element for thermal insulation having one or more the features of the invention.

Advantageous developments of the invention are described below and in the claims, with their wording hereby being explicitly included in the description by way of reference, in order to avoid unnecessarily repeated text.

According to the invention, the anchoring element comprises at least one anchoring bushing made from a concrete material and having at the radial exterior of the anchoring bushing a profiling projecting outwardly, particularly in a radial fashion.

Since the anchoring bushing surrounds the corresponding tensile reinforcement element at its radial outside and here also shows a profiling projecting towards the outside, automatically an exterior casing area of the anchoring bushing and the profiling develops, with its area being considerably larger than the casing area of the tensile reinforcement element. It is easily discernible that such an enlargement of the casing area leads to a correspondingly clear improvement of the anchoring of the anchoring element in the abutting building part. This can be used skillfully to considerably reduce the length of the tensile reinforcement element, projecting into the abutting building part. If the external diameter of the anchoring element is selected with a sufficient size to yield the desired level of anchoring of the tensile reinforcement element, here ultimately any curved, stepped, or looped progressions of the tensile reinforcement elements are no longer required. This way the tensile reinforcement element combined with an anchoring element requires considerably less space in the axial direction and can then be used at appropriate sizing when the abutting building part shows a considerably reduced length in the axial direction, perpendicular to the longitudinal direction of the insulation body.

Finally, this way the structural elements for thermal insulation can be used without any problems in installation situations with different elevation levels between the abutting building parts or in case of abutting building parts with offset levels, since the tensile reinforcement elements only project by an extremely reduced size into the abutting building parts, namely preferably only maximally to an extent which is equivalent to the thickness of the building wall. If here the abutting building part is arranged at a higher or lower level than the installation height of the structural element for thermal insulation, which is no longer relevant in case of such an advantageous structural element for thermal insulation comprising an anchoring bushing according to the invention, since the anchoring of the tensile reinforcement elements occurs already in the area of the building part abutting the joint, for example an angular section of the building part, similar to a cantilever.

It is particularly advantageous for the anchoring bushing to be made from a curing and/or hardening concrete material, particularly showing a reduced thermal conductivity in reference to cast-in-place concrete (particularly C45) and is made in particularly from a cement-containing and/or fiber-reinforced concrete material, such as high-strength or ultra-high strength concrete, such as high-strength or ultra-high strength mortar, such as a concrete-synthetic resin mixture and/or a concrete-reaction resin mixture. Such a concrete material, which shows particularly a strength equivalent to the concrete strength classification C55 or higher, up to particularly C180, is capable to compensate any increased tensile forces resulting from the enlarged cross-section without this leading to any structural damages.

Simultaneously, with the thermal conductivity reduced in reference to cast-in-place concrete, the concrete material forms an insulating layer about the corresponding tensile reinforcement element which further improves the thermal insulating features of the structural element with regards to thermal insulation.

This represents also one of the essential differentiating features in reference to a structural element for strengthening steel reinforced concrete, pre-stressed concrete, and fiber-reinforced concrete constructions, as known from EP-A 0 947 640. Because even if the tensile reinforcement elements described there are provided at their radial exterior with anchoring elements in order to form a profiling to enter into a high-strength bond with the concrete of the abutting building part, the anchoring elements there are made from a rod material or wire and are fastened directly at the tensile reinforcement elements, particularly by way of welding. Accordingly, this structural form of prior art misses, on the one hand, the anchoring bushing made from a concrete material, and thus its advantageous insulating material characteristics. On the other hand, here the connection of the anchoring elements with the profiling occurs by way of welding, so that this high-strength connection to concrete can be embodied only with reinforcement rods made from metal.

In order for the tensile reinforcement element to safely transfer the tensile forces to the anchoring element and/or for the anchoring element to securely compensate them, the tensile reinforcement element and the anchoring bushing are fastened to one another in a form-fitting, force-fitting, and/or material-to-material fashion. Here, the fastening can occur for example by wrapping and/or casting the tensile reinforcement element with the material of the anchoring bushing, thus particularly the concrete material.

With regards to the profiling, this particularly serves to transfer shearing forces, which can develop between the external surface of the anchoring element and the building part surrounding this anchoring element. Furthermore, they may also serve to compensate the tensile forces developing in the joint under load. Here, the profiling beneficially comprises ribs extending at least over a portion of the perimeter. Starting from the nominal diameter, these ribs may beneficially exhibit a rib height of at least 0.5 mm, measured in the radial direction, and preferably have a size equivalent to half the exterior radius of the anchoring bushing, thus the radial distance of the external area of the bushing from the central axis of the tensile reinforcement element in order to securely fulfill their intended function. Additionally, a rib height having a dimension of twice the diameter of the tensile reinforcement element is particularly suitable and/or advantageous.

The profiling and/or ribs may for example be made from a rod-shaped or wire material, which partially immerses into the clear exterior diameter of the anchoring bushing and partially projects from the clear exterior diameter of the anchoring bushing in the radial direction. This rod-shaped or wire material may for example form a hooping made from a steel wire, which is arranged helically along the external surface of the anchoring bushing.

Also, the profiling and/or the ribs may show an essentially saw tooth-shaped and/or serrated progression in reference to the longitudinal cross-section, particularly with facial areas extending essentially in the radial direction and facing the joint between the two building parts and having flanks extending tilted in reference to the radial direction and facing away from the joint between the two building parts.

Here, the scope of the invention includes that the profiling extends only over an axial portion of the anchoring bushing and/or that the anchoring bushing is embodied at the edge section near the joint with an essentially smooth wall at the radial exterior. This way it can be ensured that the profiling, starting from the joint, starts only behind the reinforcements of the building part and/or connection, while the section of the anchoring bushing located between the joint and the reinforcement of the building part shows a smooth wall and this way remains relatively free from stress and is protected from material fatigue and/or excessive shearing forces in the joint, which otherwise would lead to a destruction, particularly chipping and/or breaking of these edge areas near the joint.

The anchoring bushing exhibits beneficially an essentially cylindrical casing area with a particularly circular cross-section. Here, deviating from the precisely circular form, it may however have, for example on its top, a flattened section which is taken like a segment of a circle from the cylindrical anchoring bushing. This flattened section may for example serve to increase the amount of concrete covering the building part above the anchoring bushing.

In order to ensure sufficient anchoring of the tensile reinforcement element in the corresponding anchoring bushing it is recommended that the external diameter of the anchoring bushing has a size at least 1.5 times, and particularly at least twice and/or maximally 5 times, and particularly preferred maximally 3 times the size of the exterior diameter of the tensile reinforcement element.

Beneficially, the anchoring element extends only in the area of the abutting building part and abstains from projecting into the joint between the two abutting building parts; since ultimately it is precisely the section of the abutting building part in which the anchoring element can and shall fulfill its function. Additionally it is also possible that the anchoring bushing, starting from an abutting building part, projects into the insulating body and even crosses it, if applicable, and extends into the second abutting building part. In the proximity of the insulating body the anchoring element cannot fulfill its intended function of improving the anchoring, though, and even the insulating effect seems to be not or hardly of any advantage in reference to the insulating material so that to this regard it seems not even useful to allow the anchoring bushing to project beyond the abutting building part into the joint.

BRIEF DESCRIPTION OF THE DRAWINGS

Additional features and advantages of the present invention are discernible from the following description of exemplary embodiments based on the drawings; which show.

DETAILED DESCRIPTION OF THE PREFERRED EMBODIMENT

Figure 4:
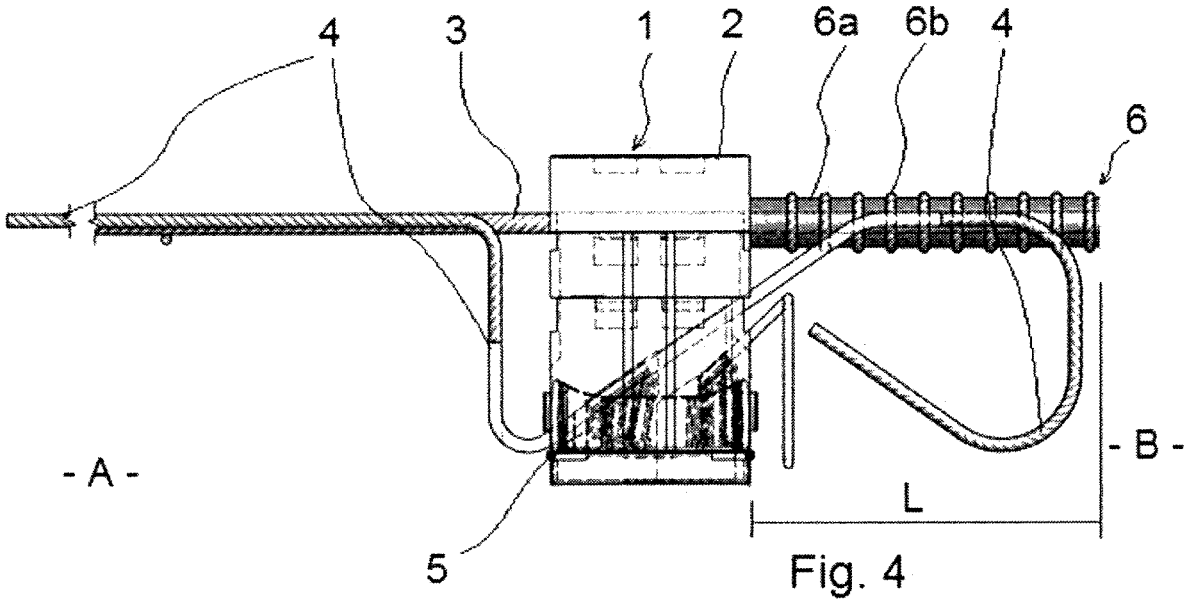
FIG. 4 a structural element for thermal insulation according to the invention in a partially sectioned side view.

FIG. 4 shows a structural element for thermal insulation 1 with a cubic insulating body 2, which is provided to be arranged in a joint of building parts, remaining between two concrete building parts (not shown here, with their position only being indicated by the reference characters A, B), and distancing these two concrete building parts A, B from each other in a thermally insulating fashion. The insulating body 2 is assembled from several parts, in order to allow the installation of reinforcement elements in the form of tensile rods 3, in the form of shearing force rods 4, and in the form of compressive elements 5. The arrangement of the reinforcement elements occurs in a manner known and common in prior art, namely by arranging the tensile reinforcement elements 3 in the upper area of the insulating body 2, extending in the installed state in the horizontal direction and serving to transfer tensile force between the building parts A, B, connected to the structural element for thermal insulation, and for this purpose anchored in these building parts.

In the lower section, the so-called pressure zone of the insulating body 2, the compressive elements 5 are arranged, namely also in the horizontal direction of extension, with them however abstaining from projecting beyond the insulating body 2. Finally, shearing force rods 4 are also provided which extend in the area of the insulating body 2 tilted in reference to the horizontal, and matching the stress to be compensated by the reinforcement elements of the structural element for thermal insulation, extend from the pressure zone at one side of the insulating body diagonally downwards into the pressure zone on the other side of the insulating body, in order to here extend angled upwards in the direction of the tensile zones and then, after another angling, parallel to the tensile reinforcement elements.

The tensile reinforcement elements 3 are now essential for the present invention, one of which, namely the tensile rod 3 in FIG. 4, is discernible primarily at the left side of the insulating body 2, while this tensile rod is indicated in the proximity of the insulating body 2 and on the right side only schematically with its external contours. Here, at the right side of the insulating body 2 in the proximity of the building part B, the tensile rod 3 comprises an anchoring element 6 surrounding it at its radial exterior. This element has, on the one hand, an anchoring bushing 6*a* and on the other hand a profiling 6*b*, provided at the radial exterior of the anchoring bushing 6*a* and projecting radially towards the outside. While the anchoring bushing 6*a* is made from a high-strength concrete, which shows better thermal conductivity, i.e. better thermal insulating features than the tensile rod 3 made from stainless steel, the profiling 6*b* is made from wire loops, which are immersed with half of their cross-section, namely with their interior, in the anchoring bushing 6*a*, while they project with the other half of the cross-section, namely with their radial exterior, from the anchoring bushing 6*a* and this way enter into a positive bonding with the concrete of the building part B.

Due to the fact that the tensile rod 3 is also provided with exterior ribs, the anchoring bushing 6*a* also enters into a positive connection with the tensile rod 3.

It is discernible from the structural form according to FIG. 4 that the anchoring bushing 6*a* ends flush with the face of the building part B, facing the insulating body 2, and starting there it extends over a relatively short axial length L (measured perpendicular in reference to the longitudinal extension of the insulating body 2 in the horizontal direction) into the building part B. The tensile rod 3 also exhibits in the proximity of the building part B the same axial length L. If the tensile rod 3 extended into the building part B without the anchoring element 6 comprising the anchoring bushing 6*a* and the profiling 6*b*, it would require considerably greater axial length L, which can frequently lead to difficult installation problems.

Alternative embodiments of an anchoring element for a structural element for thermal insulation according to the invention are shown schematically in FIGS. 1A-C, 2A-C, and 3A-E. Here, only one insulating body 2, a building part B abutting thereto, a tensile reinforcement element extending in the horizontal direction in the form of a tensile rod 3, and an anchoring element 16 (FIGS. 1A-C), 26 (FIGS. 2A-C), and/or 36 (FIGS. 3A-E) are shown.

Figure 1B:
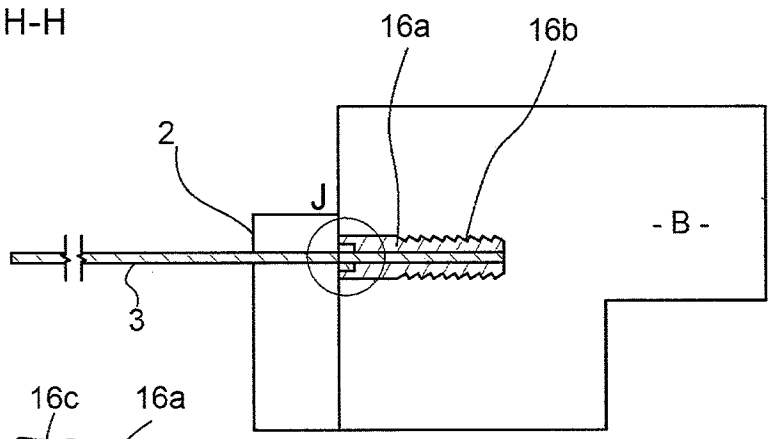
FIGS. 1A-1C a detail of a structural element for thermal insulation according to the invention in a schematic top view (in FIG. 1A), in a side view partially sectioned along the plane H-H of FIG. 1A (in FIG. 1B), and an enlarged detail of the area J of FIG. 1B (in FIG. 1C)
Figure 1C:
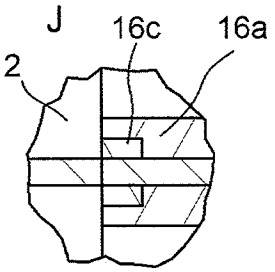
Figure 1A:
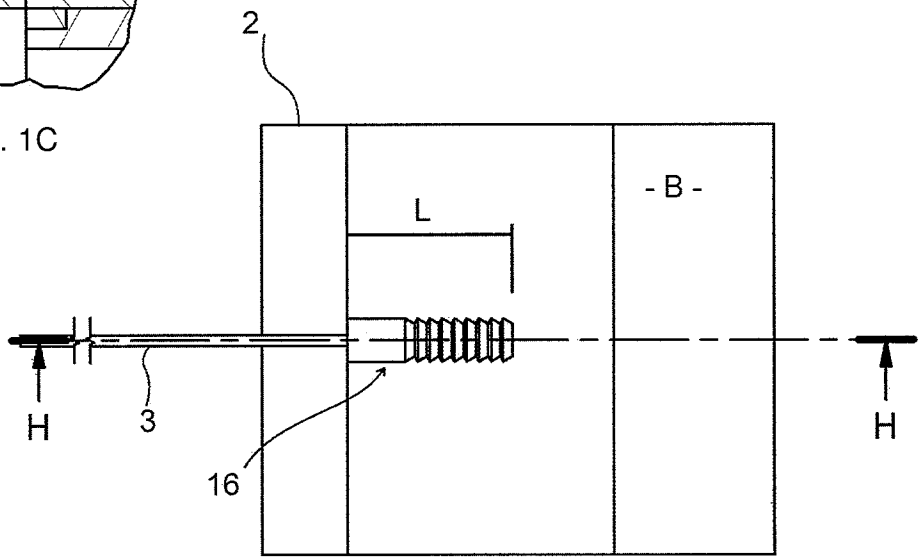

The anchoring element 16 according to FIGS. 1A-C comprises an anchoring bushing 16*a* with an integrated profiling 16*b* on its radial exterior, i.e. the profiling is made here not from a separate component, but is provided in the form of serrated ribs in the casing area of the anchoring bushing 16*a*. The profiling 16*b* begins here not directly at the front edge of the building part B, adjacent to the insulating body 2; rather the anchoring bushing 16*a* has first a smooth-walled casing area such that the profiling, entering into a positive connection with the concrete of the abutting building part B, begins only after 30% of the axial length L.

As is discernible from the detail J of FIG. 1C, the anchoring bushing 16*a* shows at its end, facing the insulating body 2, on the radial interior a retrace and/or a recess 16*c*, which ensures that the tensile rod 3, when leaving the anchoring bushing and entering the insulating body, is not subjected to any abrupt change in stiffness of its radial anchoring, which would lead to material fatigue in this transitional area. By the recess 16*c* the exit area is slightly moved out of the bushing 16*a* in the axial direction into the building part B such that a rather continuous transition of stiffness is provided in the area from the bushing to the insulating body.

Figure 2B:
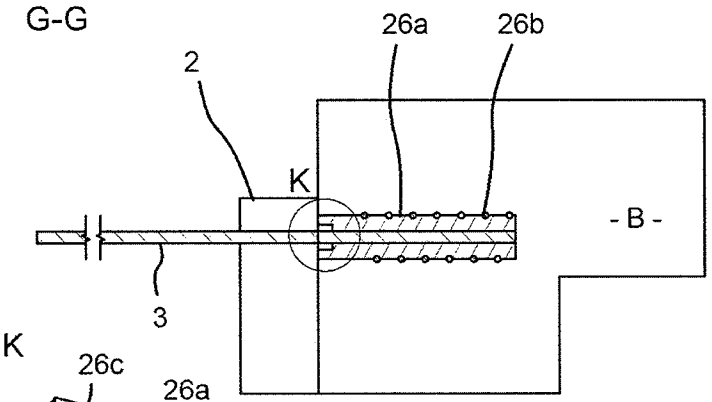
FIGS. 2A-2C a detail of an alternative structural element for thermal insulation according to the invention in a schematic top view (FIG. 2A), in a side view partially sectioned along the plane G-G of FIG. 2A (FIG. 2B), and in an enlarged detail (FIG. 2C)
Figure 2C:
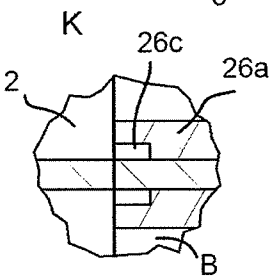
Figure 2A:
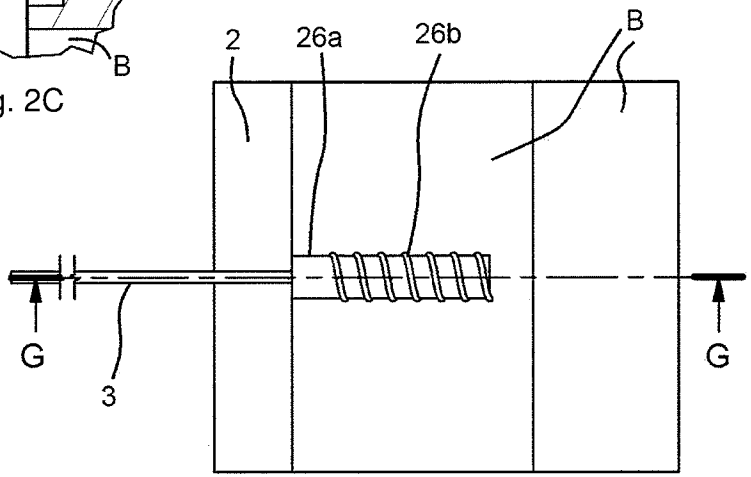
Figure 3C:
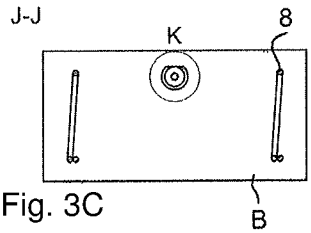
FIGS. 3A-3E a detail of another structural element for thermal insulation according to the invention in a schematic top view (FIG. 3A), in a side view partially sectioned along the plane G-G of FIG. 3A (FIG. 3B), in a vertical section along the plane J-J of FIG. 3A (FIG. 3C), in an enlarged detail of the area K of FIG. 3C (FIG. 3*d*), and in an enlarged detail of the area H of FIG. 3A (FIG. 3E)
Figure 3B:
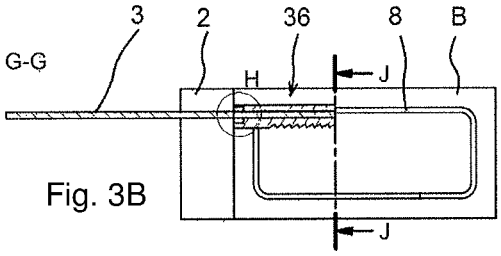
Figure 3D:
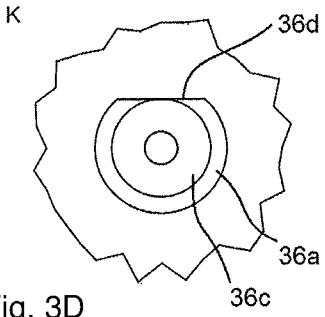
Figure 3A:
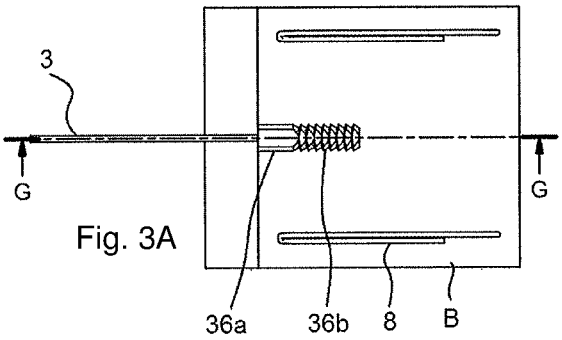
Figure 3E:
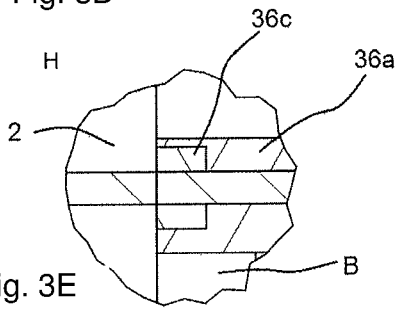

The embodiment according to FIGS. 2A-C differs in reference thereto primarily such that the anchoring element 26, in addition to an anchoring bushing 26*a*, has on its radial exterior a profiling 26*b*, which is made from helically extending circumferential loops made from a wire material. As was already the case in the exemplary embodiment shown in FIG. 4, here too the hoops 26*b* are embedded partially in the anchoring bushing 26*a* and project with a second part beyond the anchoring bushing and/or its clear exterior diameter in the radial direction towards the outside in order to here enter into a positive bond with the concrete of the building part B.

In the embodiments according to FIG. 4 an anchoring element 36 is used that shows an anchoring bushing 36*a*, which is very similar to the anchoring bushing 16*a* of FIGS. 1A-C, with the only difference that the anchoring bushing 36*a* comprises on its top a flattening 36*d* in the form of a segment of a circle, by which above the anchoring bushing more space can remain available for the concrete material of the building part B, here therefore the concrete coverage can be greater than is the case in a cylindrical exterior form of the anchoring bushing of prior art.

FIG. 4 finally shows a loop-shaped structural reinforcement 8, which is made from a reinforcement rod arranged bent into a rectangular form and arranged essentially in a vertical plane. Here it is discernible that the area of the anchoring bushing 36*a* provided with the profiling 36*b* only extends in the axial direction behind the area in which the legs of the reinforcement 8 of the building part, extending in the vertical direction, overlaps the anchoring bushing 36*a*.

In summary, the present invention offers the advantage to provide a structural element for thermal insulation with tensile reinforcement elements, which require a considerably reduced anchoring length and this way can be used primarily when in the abutting building part only little space is available in the horizontal direction for anchoring the tensile reinforcement element.

LIST OF REFERENCE CHARACTERS

1—structural element for thermal insulation
2—insulating body
3—tensile rod and/or tensile reinforcement element
4—shearing force rod
5—compressive element
6, 16, 26, 36—anchoring element
6*a*, 16*a*, 26*a*, 36*a*—anchoring bushing
6*b*, 16*b*, 26*b*, 36*b*—profiling
6*c*, 16*c*, 26*c*, 36*c*—recess at the radial interior of the anchoring bushing
36*d*—flattened section of the anchoring bushing
8—connection reinforcement
A—building part
B—building part
L—axial length by which the tensile reinforcement element 3 projects into the building part B

The invention claimed is:

1. A structural element for thermal insulation between two building parts, the structural element comprising an insulating body (2) that is arrangeable between the two building parts and reinforcement elements including at least tensile reinforcement elements (3), which in an installed state of the structural element (1) extend through the insulating body (2), horizontally and perpendicularly to a horizontal longitudinal extension of the insulating body, and respectively project in a horizontal direction in reference to the insulating body and are connectable to at least one of the two building parts, with the tensile reinforcement elements (3) comprising an anchoring element (6, 16, 26, 36) surrounding a radial exterior thereof configured to be in proximity to the at least one of the two building parts, the anchoring element (6, 16, 26, 36) comprises at least one anchoring bushing (6*a*, 16*a*, 26*a*, 36*a*) composed of a concrete material and the anchoring element (6, 16, 26, 36) includes a profiling (6*b*, 16*b*, 26*b*, 36*b*) located on an outside thereof that is positioned on a radial exterior of the anchoring bushing, and configured to transfer a load between the tensile reinforcement element and one of the two building parts.

2. The structural element for thermal insulation according to claim 1, wherein the profiling (16*b*, 36*b*) comprises ribs that extend at least over a portion of a perimeter of the anchoring bushing (16*a*, 36*a*).

3. The structural element for thermal insulation according to claim 1, wherein the profiling (6*b*, 16*b*, 26*b*, 36*b*) extends only over an axial portion of the anchoring bushing (6*a*, 16*a*, 26*a*, 36*a*).

4. The structural element for thermal insulation according to claim 1, wherein the anchoring bushing (6*a*, 16*a*, 26*a*, 36*a*) is formed with a smooth wall on a radial outer surface at an edge area near the joint.

5. The structural element for thermal insulation according to claim 1, wherein the anchoring bushing (6*a*, 16*a*, 26*a*) has a cylindrical casing area.

6. The structural element for thermal insulation according to claim 1, wherein an external diameter of the anchoring bushing (6, 16, 26, 36) has a diameter of at least 1.5 times and maximally 5 times with respect to an external diameter of the tensile reinforcement element (3).

7. The structural element for thermal insulation according to claim 1, wherein the anchoring bushing (6*a*, 16*a*, 26*a*, 36*a*) extends only in an area of an abutting one of the building parts (B) and not into a joint between the two building parts (A, B).

8. The structural element for thermal insulation according to claim 1, wherein the profiling (6*b*, 26*b*) comprises a rod-shaped or wire material, which is least partially immersed into a clear external diameter of the anchoring bushing (6*a*, 26*a*) and projects partially from the clear external diameter of the anchoring bushing in a radial direction.

9. The structural element for thermal insulation according to claim 1, wherein the profiling (16*b*, 36*b*) forms a serrated projection in reference to a longitudinal section, having facial areas extending in a radial direction adapted to face a joint between the two building parts, and flanks extending tilted in reference to the radial direction and adapted to face away from the joint between the two building parts (A, B).

10. The structural element for thermal insulation according to claim 1, further comprising a connection reinforcement element (8), which extends in a vertical plane and is formed as a rectangular-shaped loop, and the connection reinforcement element is arranged adjacent to the anchoring bushing (36*a*).

11. The structural element for thermal insulation according to claim 1, further comprising at least one of compressive elements (5) or shearing force elements (4).

12. The structural element for thermal insulation according to claim 1, wherein the anchoring bushing (6*a*, 16*a*, 26*a*, 36*a*) is made from at least one of a curing or setting concrete material.

13. The structural element for thermal insulation according to claim 12, wherein the at least one of the curing or setting concrete material comprises at least one of: a reduced thermal conductivity in reference to cast-on-site concrete, a cement-containing concrete material, a fiber-reinforced concrete material, a high-strength or ultra-high strength concrete, a concrete-resin mixture, or a concrete-reaction resin mixture.

14. The structural element for thermal insulation according to claim 1, wherein the tensile reinforcement element (3) and the anchoring bushing (6*a*, 16*a*, 26*a*, 36*a*) are connected to each other with at least one of a form-fitting, force-fitting, or material-to-material connection.

15. The structural element for thermal insulation according to claim 14, wherein the anchoring bushing (6*a*, 16*a*, 26*a*, 36*a*) is affixed to the tensile reinforcement element (3) by at least one of wrapping or casting the tensile reinforcement element (3) with a material of the anchoring bushing (6*a*, 16*a*, 26*a*, 36*a*).

16. A building structure comprising two building parts that are formed of concrete, and the structural element for thermal insulation according to claim 1 located between and structurally connecting the two building parts.

* * * * *